US005969733A

United States Patent [19]

Sheinman

[11] Patent Number: 5,969,733

[45] Date of Patent: Oct. 19, 1999

[54] APPARATUS AND METHOD FOR MULTI-JET GENERATION OF HIGH VISCOSITY FLUID AND CHANNEL CONSTRUCTION PARTICULARLY USEFUL THEREIN

[75] Inventor: Yhoshua Sheinman, Raanana, Israel

[73] Assignee: Jemtex Ink Jet Printing Ltd., Tel Aviv, Israel

[21] Appl. No.: 08/734,299

[22] Filed: Oct. 21, 1996

[51] Int. Cl.[6] ..... B41J 2/02

[52] U.S. Cl. ..... 347/75

[58] Field of Search ..... 347/74, 75, 76, 347/47

[56] References Cited

U.S. PATENT DOCUMENTS

| | | | |
|---|---|---|---|
| 4,106,976 | 8/1978 | Chiou et al. | 347/47 |
| 4,542,386 | 9/1985 | Delligatii et al. | 347/54 |
| 4,549,188 | 10/1985 | Shackleton | 192/53.332 |
| 4,550,325 | 10/1985 | Viola | 347/68 |
| 4,688,047 | 8/1987 | Braun et al. | 347/75 |
| 4,827,287 | 5/1989 | Braun et al. | 347/75 |
| 5,184,147 | 2/1993 | MacLane et al. | 347/30 |
| 5,418,561 | 5/1995 | Fujioka | 347/75 |
| 5,502,473 | 3/1996 | East et al. | 347/75 |
| 5,677,718 | 10/1997 | Crawford et al. | 347/92 |

FOREIGN PATENT DOCUMENTS

| | | | |
|---|---|---|---|
| 3-297651 | 12/1991 | Japan | 347/47 |

*Primary Examiner*—N. Le
*Assistant Examiner*—Thien Tran
*Attorney, Agent, or Firm*—Ladas & Parry

[57] ABSTRACT

A continuous jet module for discharging a high viscosity printing fluid and apparatus which includes a plurality of the printing modules is provided. The module includes a housing having a printing fluid reservoir for storing and providing said high viscosity printing fluid and a plurality of channels. The reservoir has a first longitudinal direction and includes a plurality of openings in a second direction. Each channel is disposed in one of the corresponding openings and each channel receives the high viscosity printing fluid from the reservoir through its corresponding opening and generates therefrom a continuous jet of high viscosity printing fluid.

18 Claims, 13 Drawing Sheets

FIG. 1A
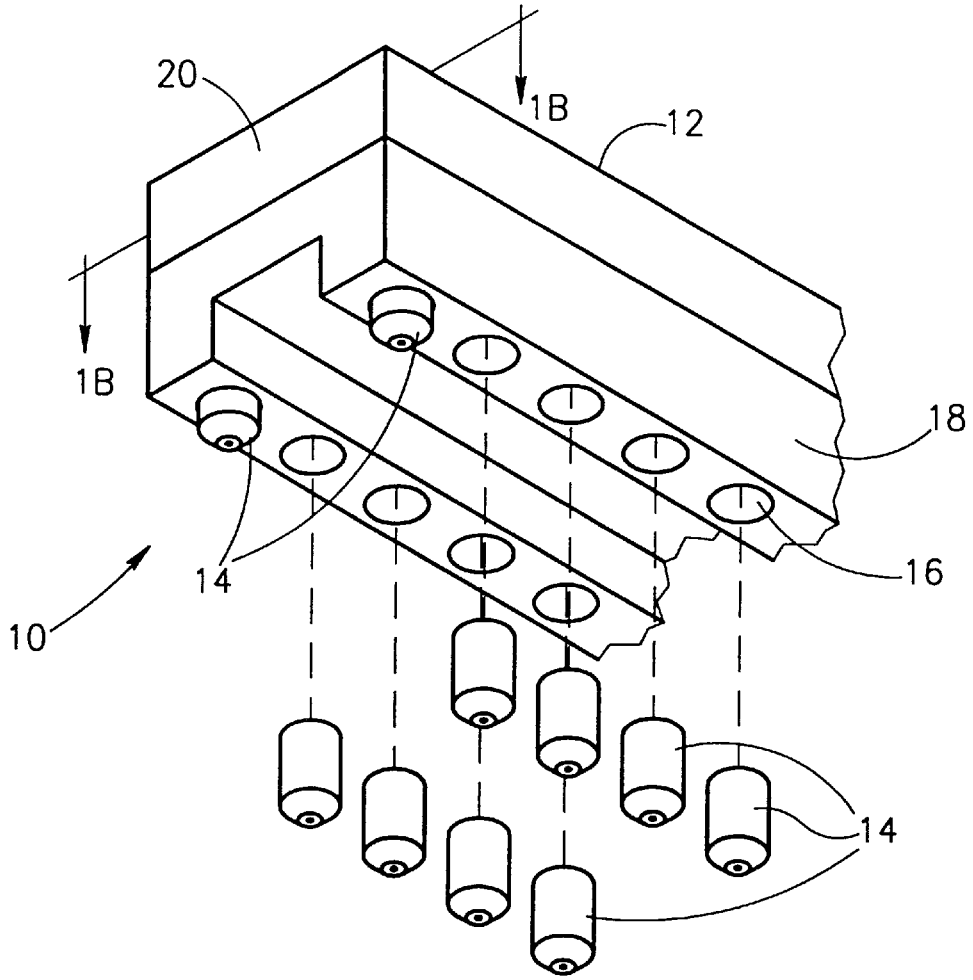
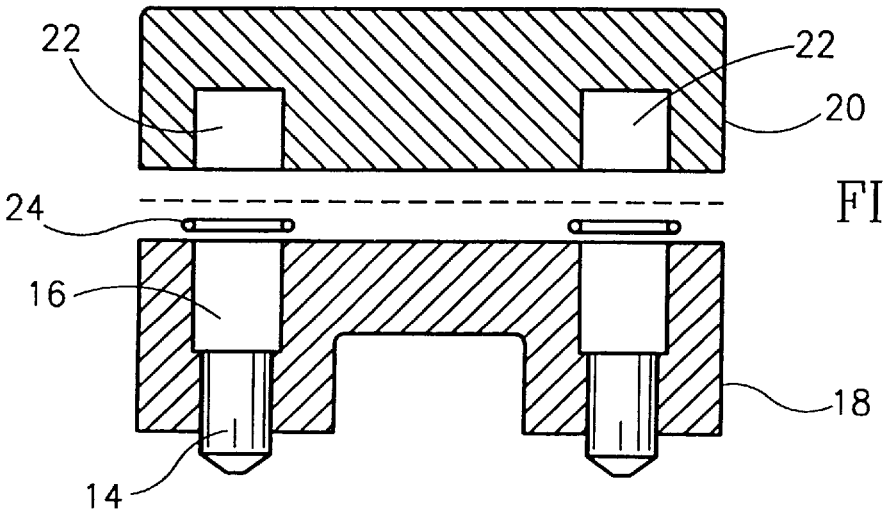
FIG. 1B

APPARATUS AND METHOD FOR MULTI-JET GENERATION OF HIGH VISCOSITY FLUID AND CHANNEL CONSTRUCTION PARTICULARLY USEFUL THEREIN

FIELD OF THE INVENTION

The present invention relates to a printing channel and a printing module for constructing a printing apparatus and a printing system for printing high viscosity printing fluids and to methods for constructing same.

BACKGROUND OF THE INVENTION

Ink jet printing systems are well known in the art. Generally speaking, ink jet printing systems fall into two main categories—continuous-jet and drop-on-demand.

In both categories, droplets are formed by forcing a printing fluid, or ink, through a nozzle. Hence, the ink-jet devices typically include a multitude of very small diameter nozzles. Drop-on-demand systems typically use nozzles having openings ranging from 30 to 100 $\mu$m while continuous-jet systems typically use nozzles having openings ranging from only 10–35 $\mu$m.

One deficiency of prior art continuous jet ink-jet systems is that they are not suitable for printing and coating with high viscosity printing and coating fluids, respectively. However, printing with high viscosity printing fluids and coating of printed substrates with a high viscosity coating fluid are desired for many applications, such as on textiles and for overprint coatings, respectively.

SUMMARY OF THE INVENTION

It is therefore an object of the present invention to provide a continuous-jet apparatus and method for printing and coating high viscosity printing fluids and coating fluids, respectively.

The term high viscosity fluid, which refers according to a preferred embodiment of the present invention to a printing ink but is not limited thereto, means throughout the description and claims a fluid having a viscosity above 10 centipoise.

The term printing will be used hereinbelow to indicate both printing and coating and when applicable combinations therebetween. For example, the term high viscosity printing fluid refers hereinbelow both to a high viscosity printing fluid, such as a high viscosity ink, and to a high viscosity coating fluid.

According to one aspect of the present invention, there is provided a continuous jet module for printing with a high viscosity printing fluid onto a substrate, comprising: a housing comprising a printing fluid reservoir for the high viscosity printing fluid, the reservoir having a first longitudinal direction and including a plurality of openings oriented in a second direction perpendicular to this first direction; and a plurality of directional channels each extending in the second direction from one of the openings, each channel having a cylindrical passageway coaxial with its respective opening and extending for a length in the second direction for feeding the high viscosity printing fluid from the reservoir and its respective opening, the cylindrical passageway of each channel including, at its end opposite to its respective opening, an end wall formed with an orifice defining a nozzle through which a continuous jet of the high viscosity printing fluid is discharged onto the substrate.

According to further features in the preferred embodiment described below, the housing comprises: a channels plate extending in the first direction having the openings therethrough oriented in the second direction; and a channels plate cover covering the channels plate and having a recess therein extending in the first direction to form the reservoir while covering the channels plate.

According to another aspect of the present invention, there is provided a channel for discharging a high viscosity fluid comprising: a channel body having a generally cylindrical shape and formed with a cylindrical passageway having, at its discharge end, an end wall formed with an orifice defining a discharge nozzle; the cylindrical passageway being formed with a first channel narrowing downstream of the channel body at the juncture with the end wall and having a generally truncated conical shape; the cylindrical passageway being formed with a second narrowing merging with the orifice and defining therewith the nozzle for discharging the jet.

According to one described embodiment, the second narrow is rounded in shape, and according to another embodiment, it is conical in shape.

According to further features in the described preferred embodiments, the diameter of the first narrowing at its downstream end is an order of magnitude larger than that of the nozzle, the diameter of the second narrowing in the upstream end of the passageway is at least five times larger than that of the nozzle, and the length of the nozzle is between 2 and 4 times larger than the nozzle diameter.

Furthermore, in accordance with a preferred embodiment of the present invention, diameter of the first narrowing at its downstream end is an order of magnitude larger than that of the nozzle and the diameter of the second narrowing in its upstream end is five times larger than that of the nozzle. The length of the nozzle is between 2 and 4 times larger than the nozzle diameter.

Furthermore, in accordance with a preferred embodiment of the present invention, the continuous jet printing apparatus also includes a control system for controlling the viscosity of the high viscosity fluid.

Furthermore, in accordance with a preferred embodiment of the present invention, the continuous jet printing apparatus also includes a charging and deflecting unit for charging and deflecting printing fluid droplets not to be applied on the substrate.

Furthermore, in accordance with a preferred embodiment of the present invention, the charging unit includes a plurality of charging plates, each plate including two conductive elements separated by an insulating separator and wherein in operation one conductive element is charged and the other conductive element is grounded.

Furthermore, in accordance with a preferred embodiment of the present invention, the continuous jet printing apparatus also includes a sensing unit for sensing malfunctions in the fluid droplets.

Furthermore, in accordance with a preferred embodiment of the present invention, the sensing unit is a movable sensing unit.

Furthermore, in accordance with a preferred embodiment of the present invention, the continuous jet printing apparatus also includes a cleaning unit operative to clean the channels and the charging plates.

Furthermore, in accordance with a preferred embodiment of the present invention, the channel is operative to discharge high viscosity fluids having a viscosity between 10–100 cps.

Additionally, in accordance with a preferred embodiment of the present invention, there is provided a method of printing, comprising forming at least one continuous jet of high viscosity printing fluid having a viscosity of 10 to 100 centipoise and applying selected printing fluid droplets of the continuous jet of high viscosity printing fluid onto a printing substrate.

Furthermore, in accordance with a preferred embodiment of the present invention, the step of applying includes the steps of generating high viscosity printing droplets from the continuous jet, charging printing fluid droplets not applied onto the printing substrate and deflecting the charged printing fluid droplets from the printing substrate.

BRIEF DESCRIPTION OF THE DRAWINGS

The present invention will be understood and appreciated more fully from the following detailed description taken in conjunction with the appended drawings in which:

FIG. 1A is a schematic bottom up view isometric illustration of an exploded view of a printing module, constructed and operative in accordance with a first embodiment of the present invention;

FIG. 1B is a schematic cross section illustration through lines IB—IB in FIG. 1A;

DETAILED DESCRIPTION OF THE PREFERRED EMBODIMENTS

Figure 2A:
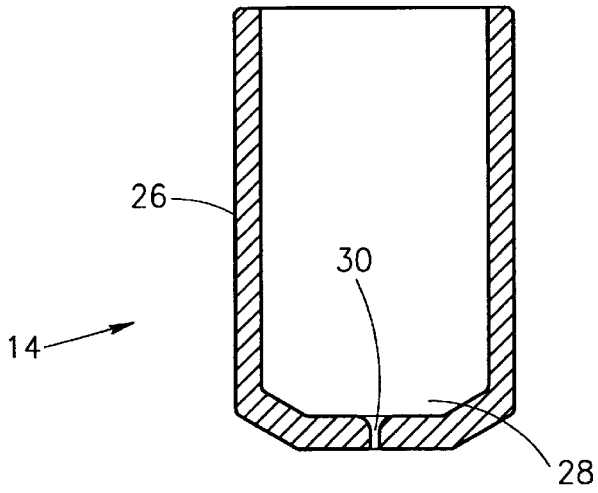
FIGS. 2A is a cross section illustrations of one channel of the plurality of channels of the printing module of the present invention.

Reference is now made to FIGS. 1A through 2B which illustrate a plurality of channels and a channels plate which constitute a continuous jet printing module for discharging a high viscosity printing fluid, generally referenced 10, constructed and operative in accordance with a preferred embodiment of the present invention.

Printing module 10 comprises a housing 12 and a plurality of channels 14. In operation, high viscosity printing fluid is provided from a printing fluid reservoir in housing 12 to each of channels 14 which form a continuous jet therefrom, each jet forming high viscosity printing droplets downstream which are applied to a printing substrate or deflected as described in detail hereinbelow.

As best seen from FIG. 1B, housing 12 comprises a channels plate 18 featuring generally vertical openings 16 therethrough and a channels plate cover 20 configured with generally horizontally oriented longitudinal recesses 22 therealong. In the nonlimiting illustrating embodiment, channels plate cover 20 includes two recesses 22 each disposed above a corresponding plurality of openings 16 in channels plate 18 in which corresponding channels are disposed in substantially equal distances therebetween.

In the illustrated embodiment, recesses 22 form a printing fluid reservoir once channels plate cover 20 is assembled with channels plate 18. Preferably, an elongated O-ring 24 is disposed intermediate the inlet of holes 16 and each recess 22 of channels plate cover 20. Recess 22 forming the printing fluid reservoir has a first direction to extend horizontally during printing. Hole 16 define a plurality of openings oriented in the second direction to extend vertically during printing. The chamber 14 extends in a second direction, i.e., vertically, during printing.

Figure 2B:
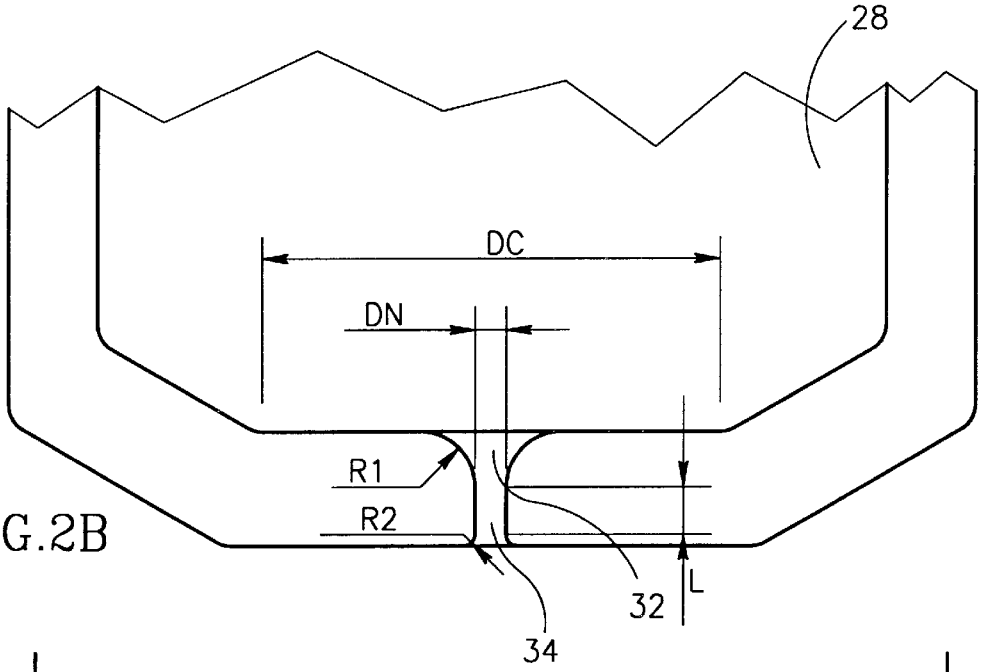
FIGS. 2B and 2C are detailed illustration of two alternative nozzles of the channel of FIG. 2A.

As best seen in FIGS. 2A and 2B, each channel 14 includes a channel body 26 having a generally cylindrical shape, and is formed internally thereof with a cylindrical passageway coaxial with its respective opening 16, and extends for a length in the second direction (i.e., vertically during printing) for feeding the high viscosity printing fluid therethrough from the reservoir (recess 22) and its respective inlet opening 16. The cylindrical passageway of each channel includes, at its end opposite to its respective inlet opening 16, an end wall formed with an orifice 30 defining a nozzle through which a continuous jet of the high viscosity printing fluid is discharged onto the substrate. The cylindrical passageway of each channel 26 is formed with a first narrowing 28 downstream of its inlet opening 16 at the juncture with the end wall formed with the discharge nozzle 30.

A particular feature of the present invention is that channel 14 is configured to enable discharge of high viscosity printing fluid in the range of 10–100 centipoise employing particular geometric structural and dimensional relationships between different parts thereof.

In the preferred embodiment of FIG. 2B, channel narrowing 28 has a generally truncated conical shape which forms an angle of about 120 degrees, the length of the truncated end being DC, for configuring the streamlines of the high viscosity printing fluid into nozzle 30. Nozzle 30 includes a second narrowing of generally partially circular shape 32 having a curvature defined by radius R1, merging with an orifice 34 and defining therewith a nozzle for discharging the printing jet formed in channel 14 orifices 34 has a diameter denoted DN and a nozzle opening of partially circular shape which curvature is defined by radius R2.

In the preferred embodiment of FIG. 2B, a preferred nozzle aspect ratio defined by the ratio between the length of nozzle aperture 34 denoted L and DN is provided by configuring channel 14 such that the length of nozzle aperture 34 indicated by the bar referenced L is 1.8 to 6 times and preferably 1.8 to 4 times larger than DN.

Additional preferred geometrical characteristics of channel 14 are as follows. First, the diameter of narrowing 28 in its truncated downstream end (DC) is an order of magnitude larger than DN. Second, R1 is about five times larger than R2 and preferably larger by 20 percent than DN.

It will be appreciated that the channel of FIG. 2B is particularly suitable for channels having a DN which is equal or larger than 60 microns. Typical working parameters for a printing module with the channels of FIG. 2B for printing high viscosity fluids having a viscosity of 10–100 centipoise (CPS) are as follows. Channels pressure is between 5–8 bars, preferably 5–6 bars for viscosities closer to 10 cps and 7–8 bars for viscosities closer to 100 cps, jet speed is 8–10 meters/second, Reynolds number is between 30 and 50 and drop rate is between 15 and 25 Khz.

A particular feature of the present invention is that the geometric characteristics of the channels are optimized in accordance with the diameter of DN. For DN smaller than 60 microns the channels are configured as illustrated in FIG. 2C to which reference is now made.

Figure 2C:
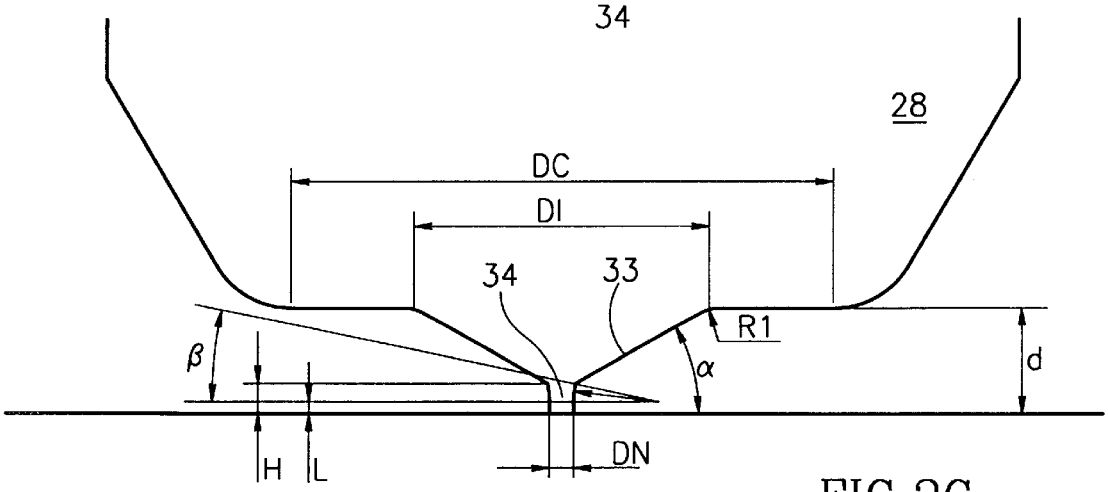

In the channel of FIG. 2C, narrowing 28 is generally similar to that of the channel of FIG. 2B. The second narrowing includes a second truncated cone indicated by 33 connected to the truncated downstream end of narrowing 28 in a rounded edge having a radius R1. Downstream of said second truncated cone having an angle alpha is channel nozzle 34 having a diameter DN and connected thereto in a slightly rounded edge having an angle beta.

The channel of FIG. 2C is particularly suitable for DN smaller than 60 microns and for applying printing fluids having a viscosity between 10–45 cps. Preferred operational parameters of the channels of FIG. 2C are similar to that of the channel of FIG. 2B, however with drop rate of 15–40 KHz.

Figure 3:
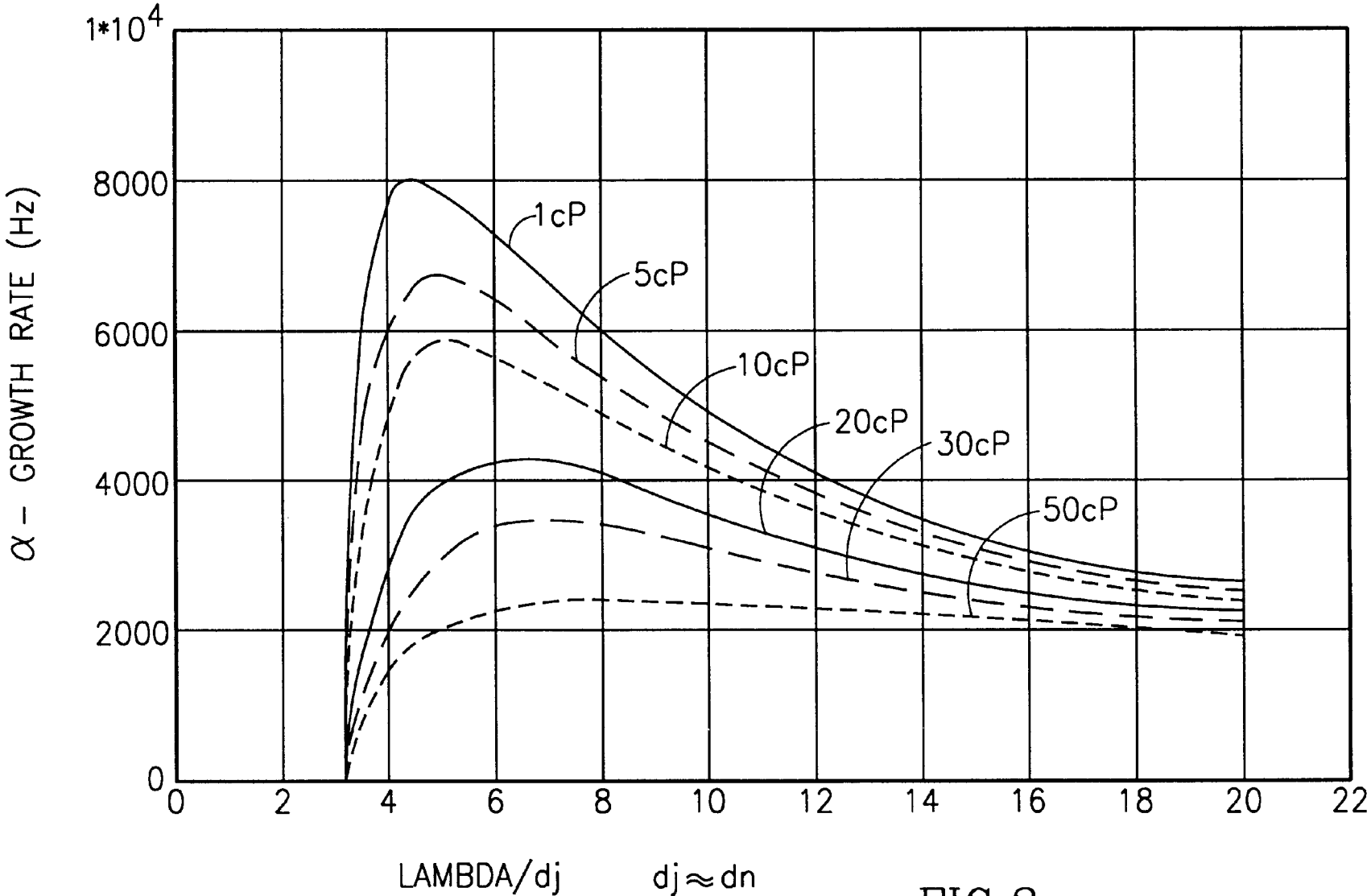
FIG. 3 is a graph illustrating the growth rate of the ink drops (Y-Axis) as function of lambda\dj which is the normalized wavelength (X-Axis)

Reference is also made to FIG. 3 which illustrates a graph depicting the printing fluid droplets growth rate (Y-axis) at 45 dyne/cm as function of the normalized wavelength (X-axis) which is the ratio between the length between consecutive droplets (lambda) and the nozzle aperture diameter 34 (DN). As clearly seen from FIG. 3 the preferred normalized wavelength for printing fluid droplets growth rate is when lambda\DN is greater than 3 and more preferably between 4–6.

A preferred method of constructing a printing apparatus comprising at least one printing module 10 is now described with reference to FIGS. 4A–4F which are pictorial illustrations of the construction steps and FIG. 5 which illustrates the method in block diagram form.

Figure 4A:
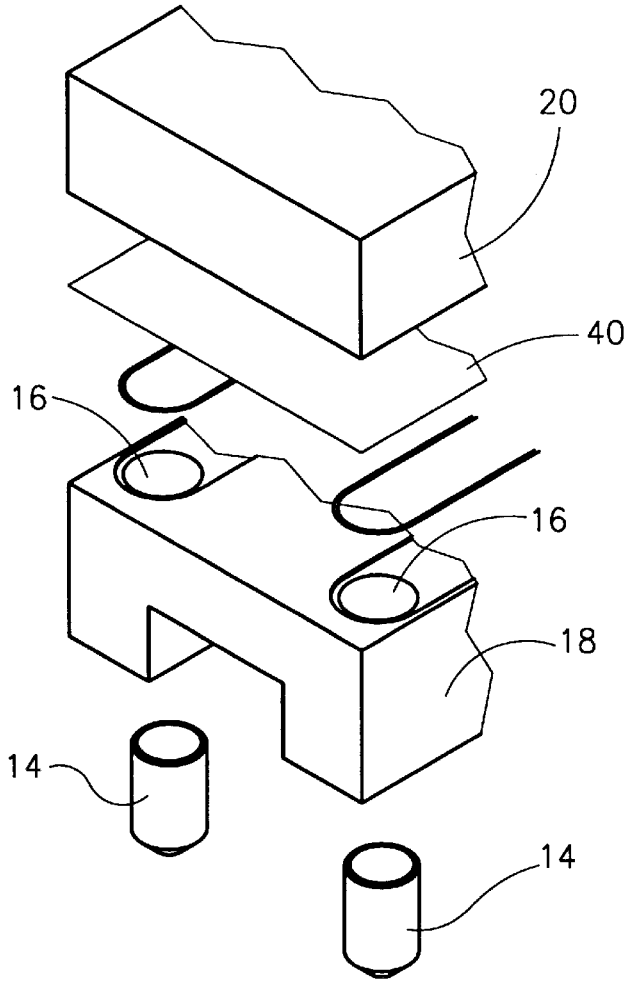
FIGS. 4A–4F are schematic isometric illustrations which illustrate a preferred method for constructing a printing apparatus constructed from a plurality of printing channels of the present invention.
Figure 5:
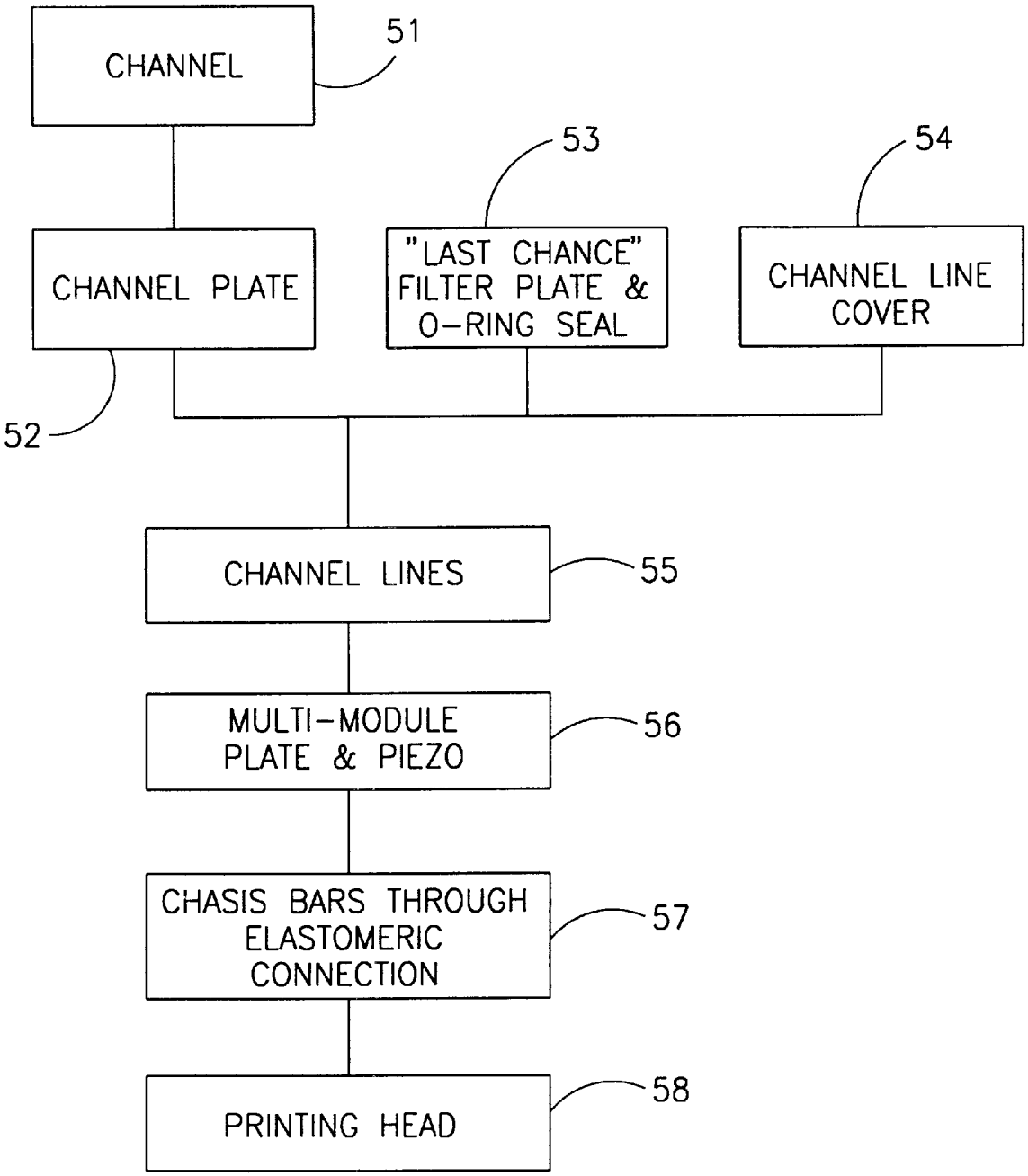
FIG. 5 is a block diagram illustration of the method illustrated in FIGS. 4A–4F.
Figure 6:
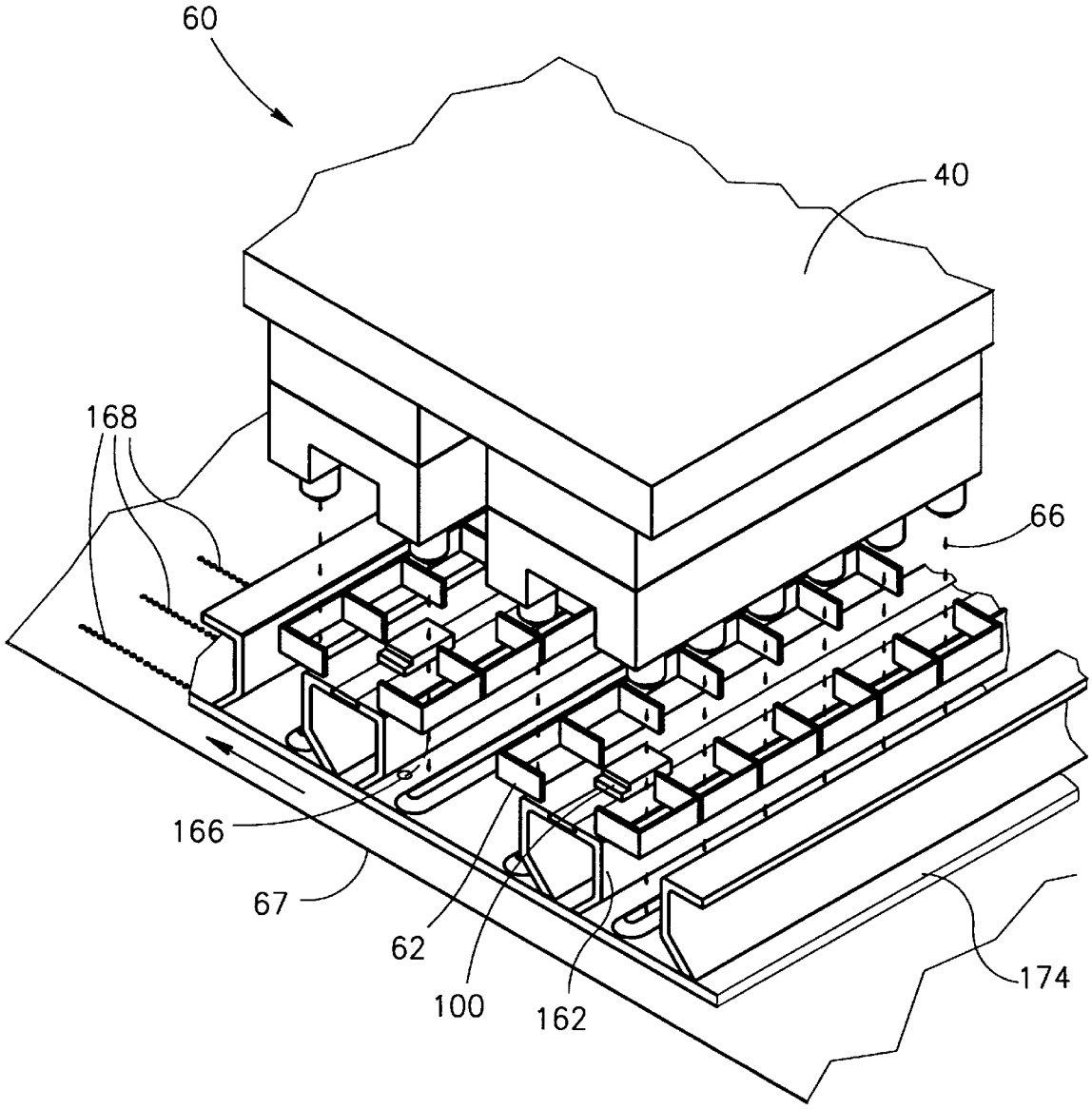
FIG. 6 is a schematic isometric illustration of a printing apparatus, constructed and operative in accordance with a preferred embodiment of the present invention.

In step 51 (FIG. 5) as shown in FIG. 4A, each channel 14 is disposed in a corresponding opening 16 of channel plate 18. In a preferred embodiment, channels 14 are made of sintered ceramics and channel plate 18 as well as channel plates cover 20 are made of any suitable material, such as brass.

Figure 4B:
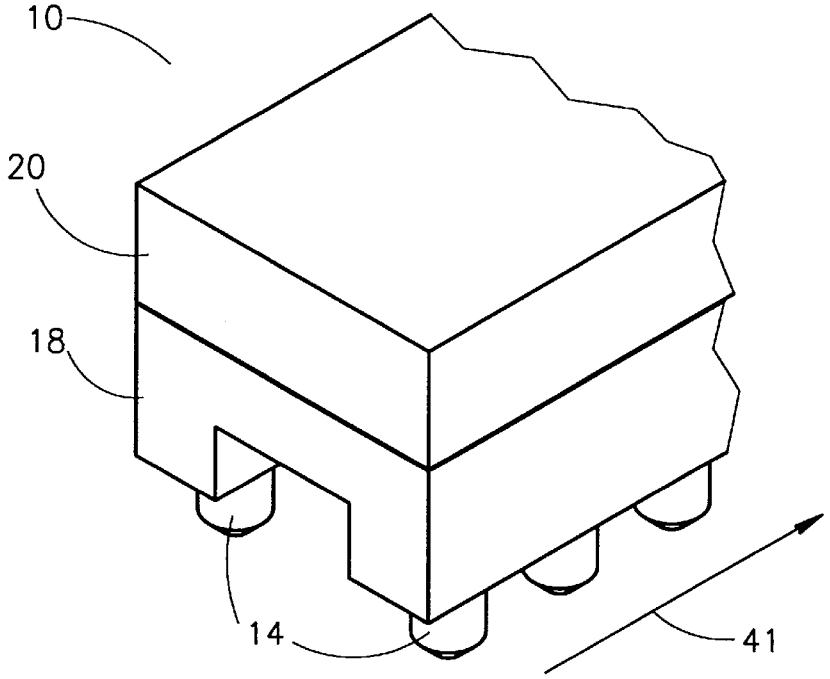

In steps 52, 53 and 54 the inlet of each opening 16 of channels plate 18 is covered with the elongated 0-ring seal 24 and preferably also with a common filter 40, known in the art as last chance filter, and closed by channels plate cover 20 to provide printing module 10 as illustrated in FIG. 4B. Printing module 10 includes a plurality of channel lines 41, each operative to apply a line of a printing fluid on a printing substrate. In the nonlimiting illustrated embodiment, printing module 10 includes two channel lines 41.

Figure 4C:
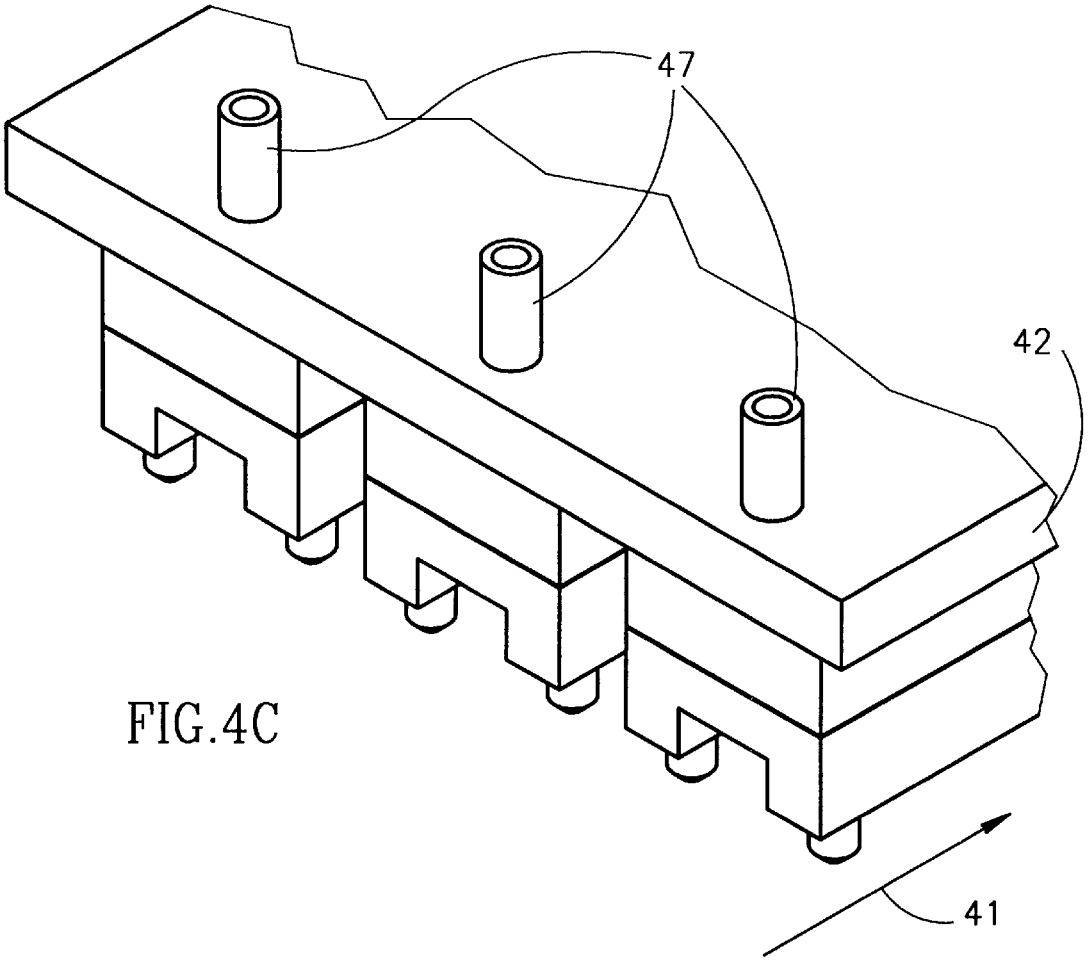
Figure 4D:
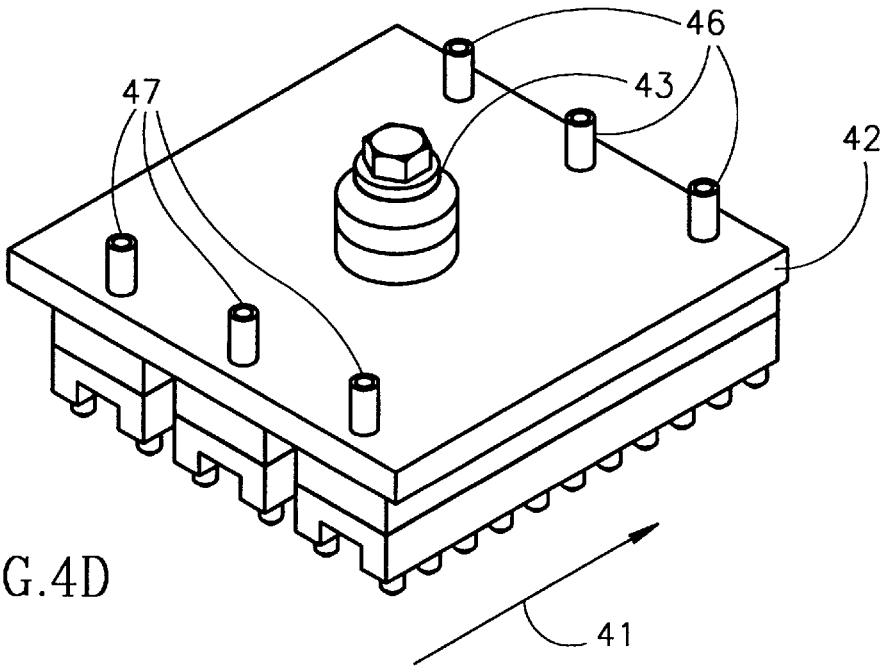

At least one printing module and preferably a plurality of printing modules 10 are assembled to form channel lines as indicated by step 55 and illustrated in FIG. 4C. Printing modules 10 are assembled so as to generate a plurality of channel lines 41 via a printing apparatus multi-module plate 42 to which a common piezo electric transducer 43 is connected as illustrated in FIG. 4D and indicated by step 56.

Figure 8:
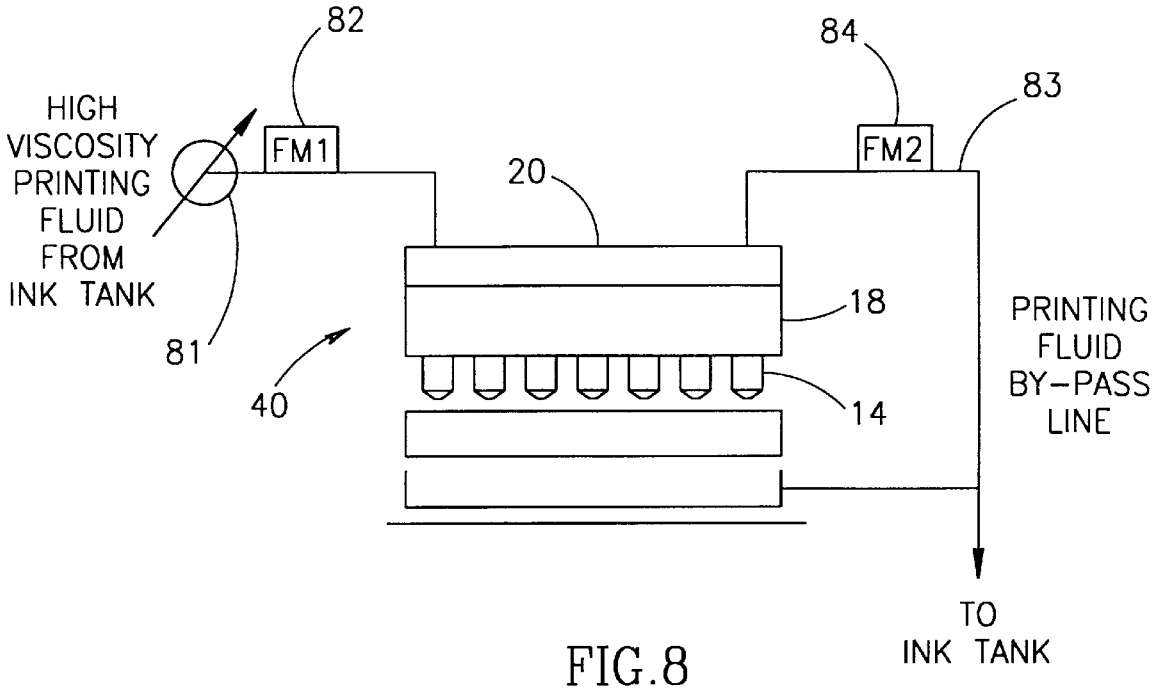
FIG. 8 is a schematic pictorial illustration of the viscosity control system of the printing apparatus of FIG. 6.

In the illustrated embodiment, each printing module 10 has an inlet 46 and an outlet 47 which are controlled as described in detail with reference to FIG. 8.

Figures 4E, 4F:
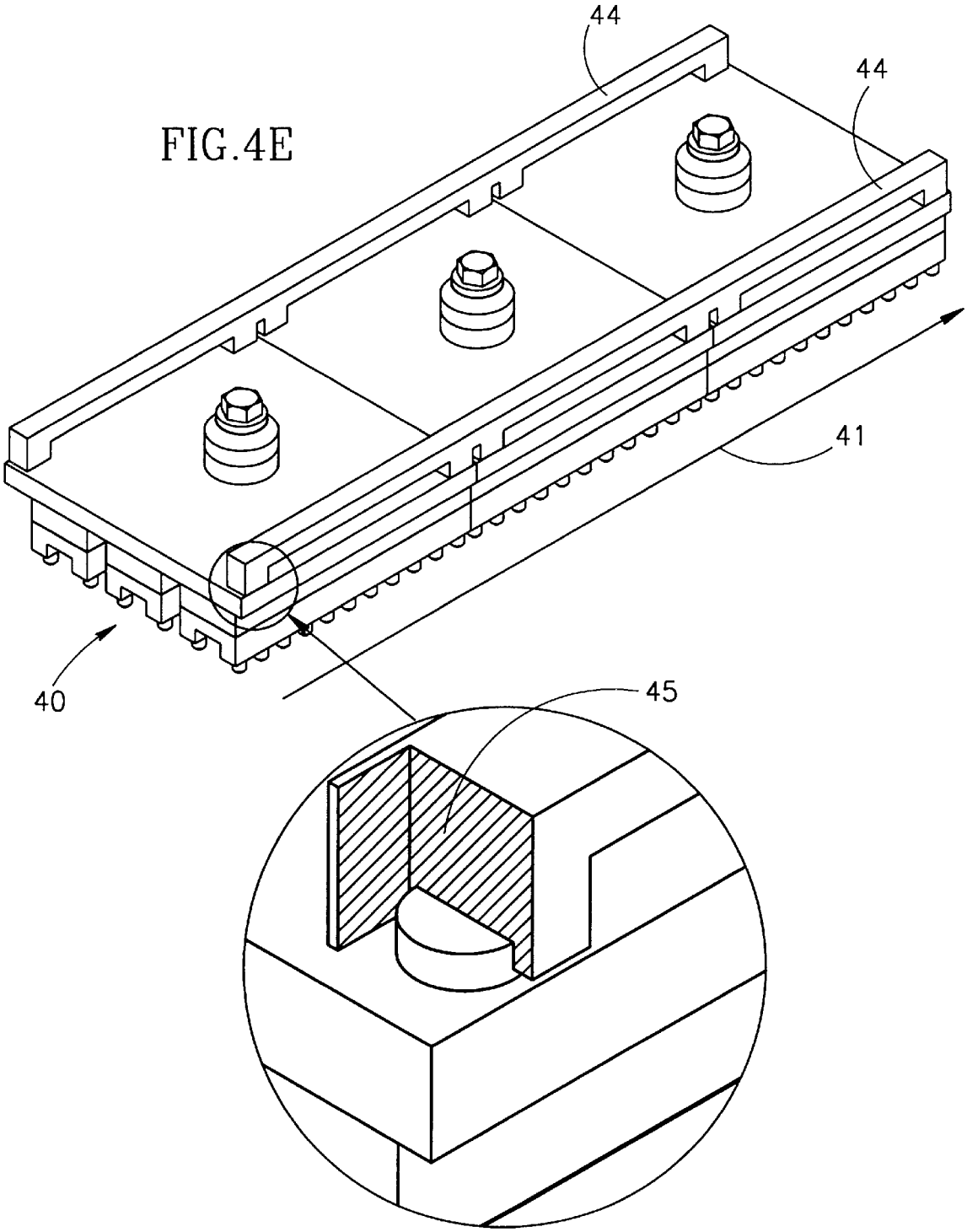

In step 57, a plurality of multi-module plates are connected to chasis bars 44 via elastomeric connections 45 as illustrate in FIGS. 4E and 4F, respectively and indicated by step 57 to provide an elongated printing head, referenced 40 (FIG. 4E) and indicated in step 58.

While in the illustrated embodiment three multi-modules are assembled together in FIG. 4E, it will be appreciated that any number of multi-modules may be assembled to extend channel lines 41 to a desired length.

It will be appreciated that the method for assembling the printing head 40 described hereinabove with reference to FIGS. 4A–4F and 5 is an exemplary method and is not intended to limit the scope of the present invention. Thus, the present invention covers a printing head 40 and all the components thereof irrespective of the method for assembling them into printing head 40.

Printing head 40 is the preferred printing head for a printing apparatus, generally referenced 60 and described hereinbelow with reference to FIGS. 6–10.

Printing apparatus 60 is operative to print a high viscosity printing fluid on a printing substrate, such as a textile fabric or to coat a printed substrate with a suitable overprint coating. Printing apparatus 60 includes a printing head, preferably printing head 40, a printing fluid viscosity monitoring system described in detail with reference to FIG. 8 and not shown in FIG. 6, a printing fluid droplets charging unit described in detail with reference to FIG. 9, a printing fluid droplets deflection unit and a sensing and cleaning unit described in detail with reference to FIG. 10 hereinbelow.

In the illustrated embodiment, printing apparatus 60 comprises printing head 40 which applies printing fluid droplets 66, charging unit 62 charging droplets 66, a deflection unit 162 for deflecting some of droplets 66, collection gutters 174 for collecting deflected printing fluid droplets 166 which are deviated from their generally vertical trajectory so they will not reach printing substrate 67, and a movable sensing and cleaning unit 100. Undeflected droplets 168 reach printing substrate 67 and generate a pattern therein.

Figure 7:
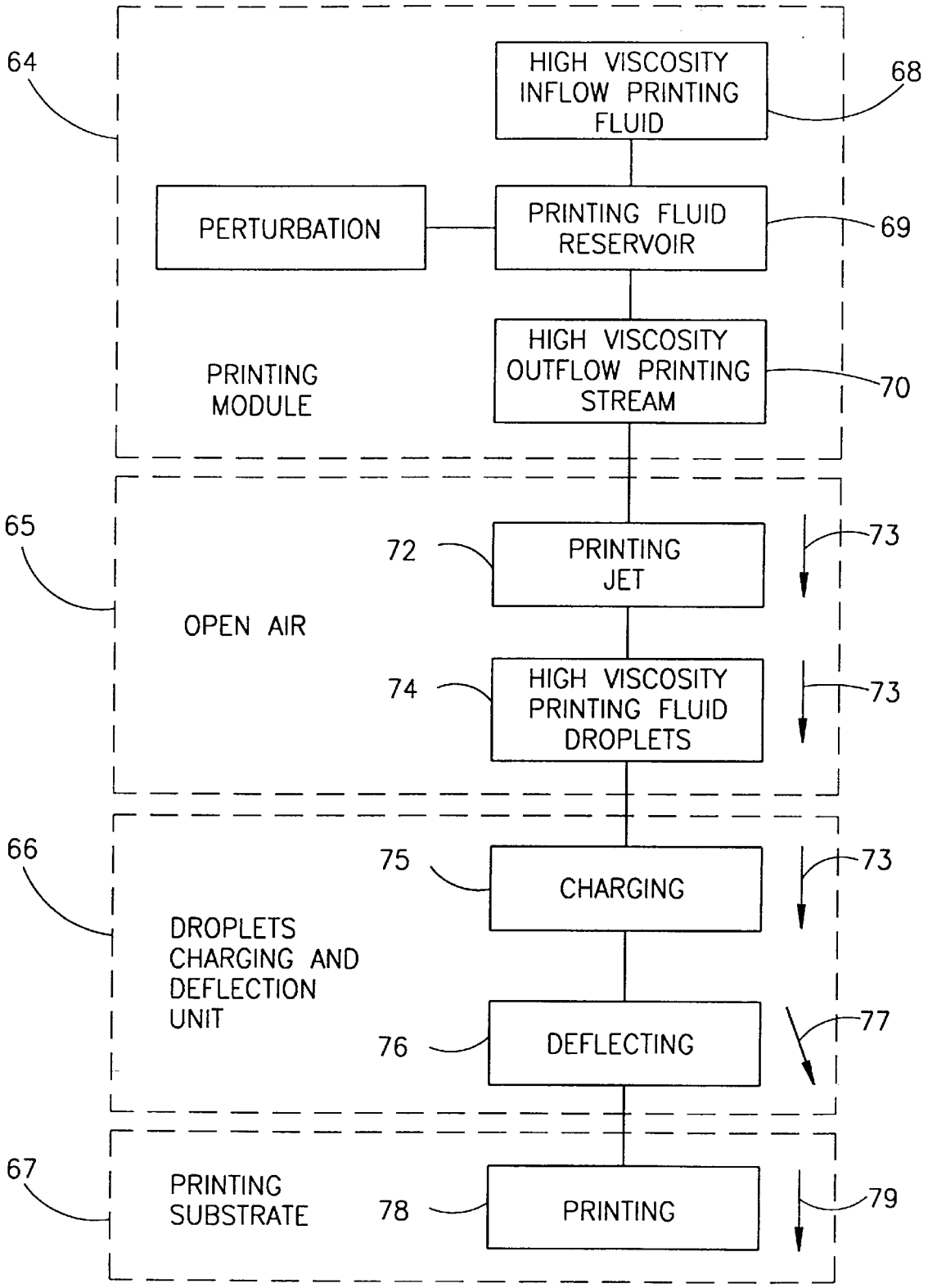
FIG. 7 is a schematic block diagram illustrating the operation of the printing apparatus of FIG. 6.

The operation of printing apparatus 60 is described now with reference to the block diagram illustration of FIG. 7. The method preferably includes four major steps: the step 64 of forming a jet of a printing fluid in a predetermined direction which take place in each channel 14, the step of generating high viscosity printing fluid droplets from the jet of printing fluid in the same predetermined direction which takes place in the open air as indicated by step 65, the step of deviating selected ones of the printing fluid droplets from the predetermined direction by deflection unit 62 and indicated by step 66 and the printing step in which a pattern of high viscosity printing fluid droplets forming an image to be printed on a printing substrate is printed as indicated by 67.

Step 64 of generating a printing jet comprises forming a continuous stream of high viscosity printing fluid which is converted in the open air to a unidirectional printing jet. In a preferred embodiment, a printing fluid inflow is inputted (block 68) into the printing fluid reservoir formed by recesses 22 of printing module 10 (FIGS. 1A and 1B) as indicated by block 69, the output from which forms the stream of printing fluid as indicated by block 70.

According to a preferred embodiment of the present invention, the printing fluid in the reservoir is perturbed by the piezo electric transducers 43 (FIG. 4D) so as to control the rate of high viscosity printing fluid droplets generation from the printing jet.

The printing jet travels as indicated by step 72 in a preferred predetermined direction, preferably downwards as indicated by arrow 73 so as to form printing fluid droplets 74 having the same predetermined direction.

In order to effect printing, the printing fluid droplets are selectively charged (step 75) while travelling in the predetermined direction 73 for subsequent selective deflection thereof (step 76) as described in detail with reference to FIGS. 9 and 10 hereinbelow so as to deviate the printing fluid droplets which do not form part of the printed image as indicated by arrow 77.

The droplets not being deflected at step 76 impinge the printed substrate, thereby forming the printed image as indicated by step 78 and arrow 79.

A particular advantage of the present invention is the on-line control of the generated high viscosity printing fluid jet parameters employing the on line flow measurement system described with reference to FIG. 8.

In the illustrated system, the high viscosity printing fluid for each plurality of channels aligned with one recess 22 of housing 12, is provided via a printing fluid inlet 81. A first flow meter 82 measures the printing fluid flow rate prior its entry into channels 14 and excess printing fluid is collected via the printing fluid by pass 83. A second flow meter 84 measures the printing fluid flow rate in bypass 83.

In operation, on line measurements of flow rate at the inflow end and at the bypass end are made and fed to printing apparatus 60 control computer (not shown) which performs the following determinations which provide continuous control on the high viscosity printing fluid characteristics.

First, the average discharge for each channel 14 is determined from equation 1 as follows:

$$Q(av)=(FM1-FM2)/Nn \quad \text{(Eq. 1)}$$

wherein Q(av) is the average discharge per channel FM1 is the flow rate measured by first flow rate meter 82, FM2 is the flow rate measured by second flow meter 84 and Nn is the number of channels fed by the single reservoir formed by recess 22.

Q(av) is used to measure the mean velocity at each channel as follows from equation 2 below:

$$Vj=Q(av)/Aj=Q(av)/(0.25\ \pi dn^{2*}\{Cr^2\ (Vj)\} \quad \text{(Eq. 2)}$$

wherein Aj is the jet cross sectional area, dj is the diameter of channel's nozzle (FIG. 2B) and $C_r$ is the ratio between the diameter of the jet and the diameter of the channel's nozzle. $C_r$ is a function of Vj [$C_r$ (Vj)].

Vj is used to control the operational characteristics of printing apparatus 60. In a preferred embodiment, the frequency in which the piezoelectric device 43 vibrates is adjusted during calibration of printing apparatus 60 so as to avoid satellite conditions, i.e the existence of additional undesired splitting of the printing fluid droplets.

Vj is also used to control the viscosity of the printing fluid together with the inflow pressure at inlet 81 since P depends on Vj as follows from equation 3 below:

$$P=AVj^2+BVj^*\mu \quad \text{(Eq. 3)}$$

wherein A and B are constants.

Since the present invention is directed to a printing apparatus for printing a high viscosity fluid, for Vj smaller than 10 meters per seconds AVj is much smaller than P thus the viscosity is a function of the relationship between the pressure and the jet velocity as follows:

$$\mu=(P-A\ Vj^2)/BVj\approx P/BVj \quad \text{(Eq. 4)}$$

A particular feature of the present invention is that by adjusting the pressure for an adjusted velocity, a desired viscosity for the printing fluid is attained.

Figure 9:
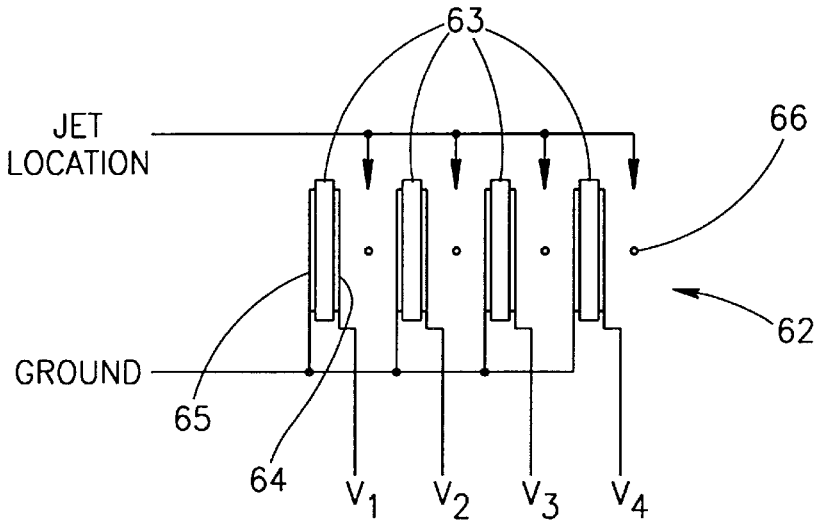
FIG. 9 is a schematic illustration of a charging unit of a charging apparatus of the printing apparatus of FIG. 6.

Reference is now made to FIG. 9 which is a top view of a charging unit 62. In the illustrated embodiment, a plurality of charging plates 63, preferably of elongated shape and disposed intermediate individual channels are shown. Each charging plate 63 includes a data side 64 and a grounded side 65. In operation, voltage is applied to each data side 64 of each plate as indicated by V1–V4 so as to charge printing fluid droplets indicated by 66 in a manner known in the art and representing an information pattern and described with reference to FIG. 7 hereinabove.

A particular feature of the charging plates 63 is that one side thereof is grounded so as to avoid cross talk between printing fluid droplets applied by adjacent channels.

Figure 10A:
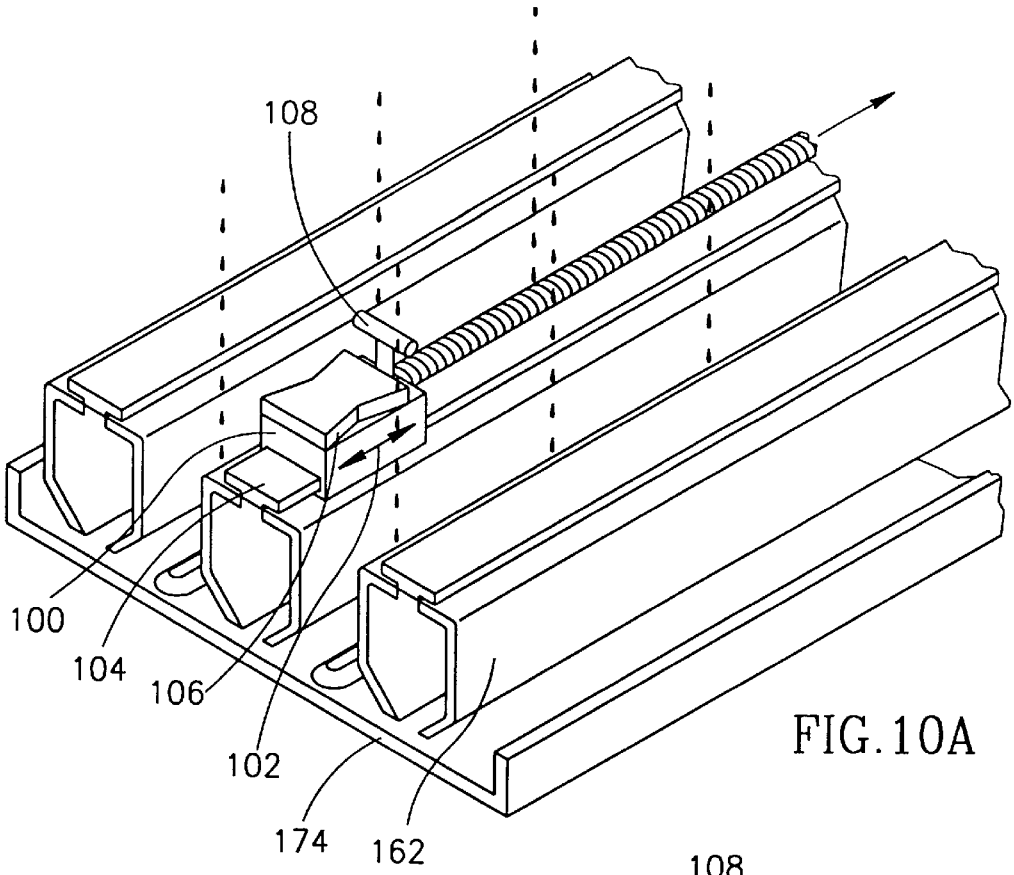
FIGS. 10A and 10B are schematic illustration of a sensing and cleaning unit of the printing apparatus of FIG. 6 in two working positions.
Figure 10B:
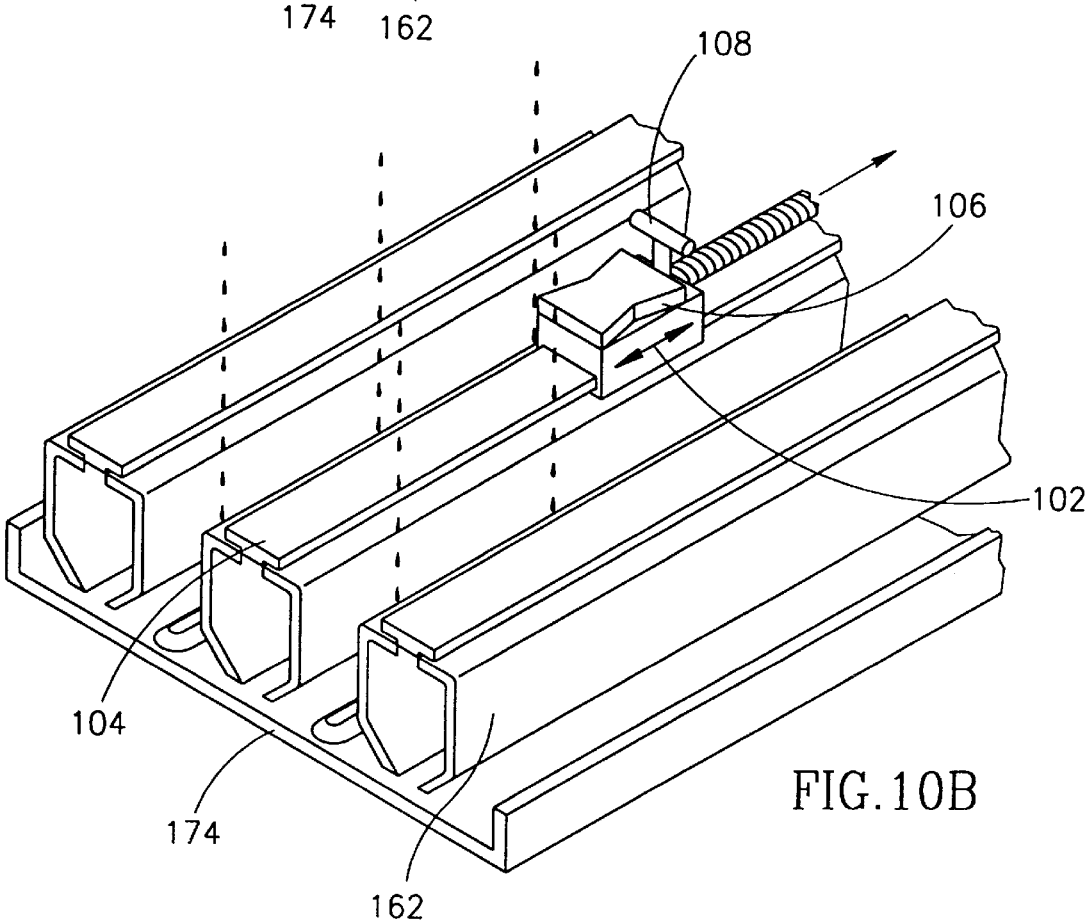

A particular feature of printing apparatus 60 is the sensing and cleaning unit 100 described now with reference to FIGS. 10A and 10B. Sensing and cleaning unit 100 moves back and forth as illustrated by arrow 102 along a slide 104 which in the illustrated embodiment forms part of deflection unit 162, so as to detect any malfunctions in the plurality of printing fluid droplets 66 and to clean the plates 63 of charging unit 62 and the tips of channels 14.

Sensing and cleaning unit 100 includes sensor 106 located on both sides thereof and a cleaning suction device 108. In operation, sensor 106 continuously analyzes that the printing fluid droplets 66 are steady. In case of malfunction of one printing fluid channel, as illustrated in FIG. 10B, sensing and cleaning unit 100 stops and provides an indication of the malfunctionality to a control system of printing apparatus 60 (not shown), preferably a computer.

Sensing and cleaning unit 100 cleans the tips of the channels 14 and the charging plates before and after a printing batch is performed.

A particular advantage of the present invention is that printing apparatus 60 may be used as a single color or multicolor printing head for any suitable type of printing system as described hereinbelow with reference to FIGS. 11 and 12.

Figure 11:
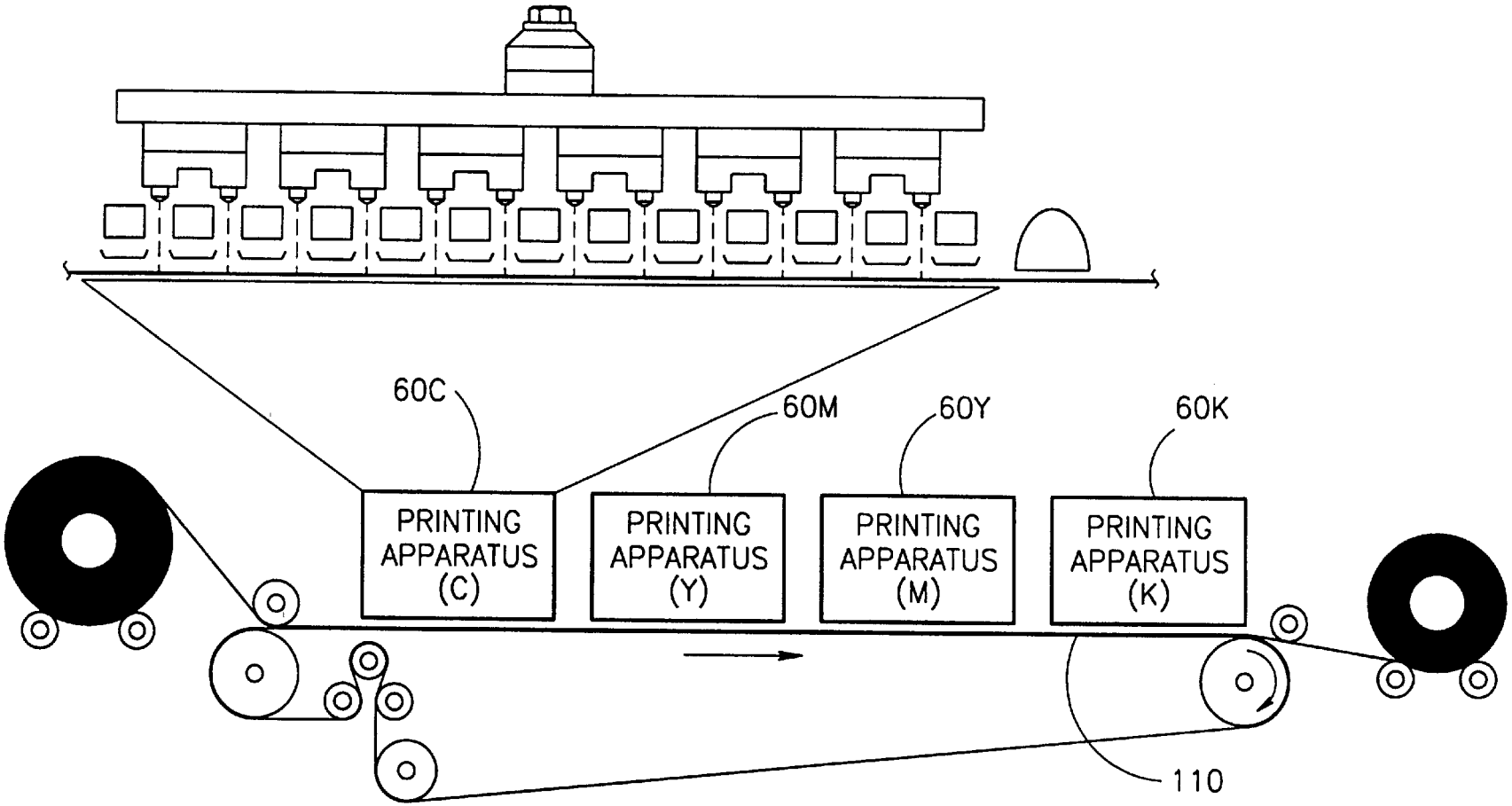
FIG. 11 is a schematic isometric illustration of a four color web printing system, constructed and operative in accordance with a preferred embodiment of the present invention.

In the embodiment of FIG. 11, a web printing system is shown with each printing apparatus 60 used as a single color printing head. As illustrated, four printing apparatus 60 each operative to print one of the process color Cyan, Yellow, Magenta and Black (CYMB) and designated 60C, 60Y, 60M and 60K, respectively, apply a high viscosity printing fluid on web 110.

Figure 12:
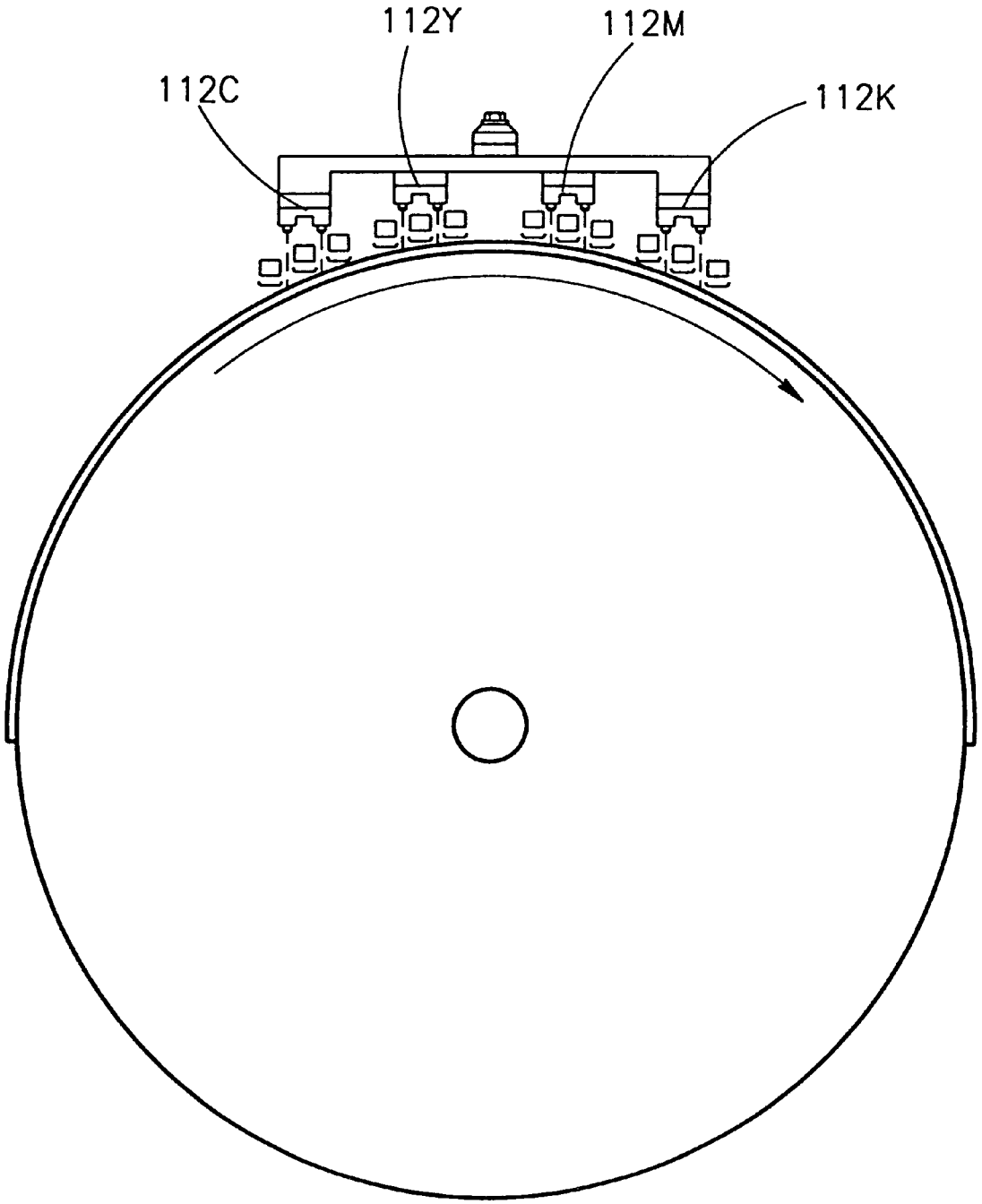
FIG. 12 is a schematic isometric illustration of a four color sheet fed printing system, constructed and operative in accordance with another preferred embodiment of the present invention.

In the embodiment of FIG. 12 a sheet fed external drum printing system is illustrated. In the embodiment of FIG. 12, a single printing apparatus 60 is utilized to apply the four process colors CYMB wherein each extended multi-module sharing same printing fluid reservoir is operative to apply a different color as indicated by 112C, 112Y, 112M and 112K, respectively.

It will be appreciated that the preferred embodiments described hereinabove are described by way of example only and that numerous modifications thereto, all of which fall within the scope of the present invention, exist.

It will also be appreciated by persons skilled in the art that the present invention is not limited by what has been particularly shown and described herein above. Rather the scope of the invention is defined by the claims which follow:

I claim:

1. A continuous jet module for printing with a high viscosity printing fluid onto a substrate, comprising:

a. a housing comprising a printing fluid reservoir for said high viscosity printing fluid, said reservoir having a first longitudinal direction and including a plurality of openings oriented in a second direction perpendicular to said first direction; and b. a plurality of directional channels each extending in said second direction from one of said openings, each channel having a cylindrical passageway coaxial with its respective opening and extending for a length in said second direction for feeding said high viscosity printing fluid from said reservoir and its respective opening, the cylindrical passageway of each channel including at its end opposite to its respective opening, an end wall formed with an orifice defining a nozzle through which a continuous jet of said high viscosity printing fluid is discharged onto said substrate.

2. A module according to claim 1, wherein said housing comprises:

a. a channels plate extending in said first direction having said openings therethrough oriented in said second direction; and b. a channels plate cover covering said channels plate and having a recess therein, extending in said first direction to form said reservoir while covering said channels plate.

3. A module according to claim 2 wherein said openings in said channels plate are substantially equally spaced from each other in said first direction.

4. A module according to claim 1 wherein each said channels comprises:

a. a channel body having a generally cylindrical shape and formed internally thereof with said cylindrical passageway;

b. said cylindrical passageway being formed with a first channel narrowing downstream of said channel body at the juncture with said end wall and having a generally truncated conical shape;

c. said cylindrical passageway being formed with a second narrowing merging with said orifice and defining therewith said nozzle for discharging said jet.

5. A module according to claim 4 wherein said second narrowing is rounded in shape.

6. A module according to claim 4 wherein: said second narrowing is conical in shape.

7. A channel for discharging a high viscosity fluid comprising:

a. a channel body having a generally cylindrical shape and formed with a cylindrical passageway having, at its discharge end an end wall formed with an orifice defining a discharge nozzle;

b. said cylindrical passageway being formed with a first channel narrowing downstream of said channel body at the juncture with said end wall and having a generally truncated conical shape;

c. said cylindrical passageway being formed with a second narrowing merging with said orifice and defining therewith said nozzle for discharging said jet.

8. A channel according to claim 7 wherein said second narrowing is rounded in shape.

9. A channel according to claim 7 wherein the diameter of said first narrowing at its downstream end is an order of magnitude larger than that of said nozzle, the diameter of said second narrowing in the upstream end of said passageway is at least five times larger than that of said nozzle, and the length of said nozzle is between 2 and 4 times larger than said nozzle diameter.

10. A channel according to claim 7 wherein said second narrowing is conical in shape.

11. A continuous jet printing apparatus including a plurality of the printing modules for applying a plurality of high viscosity fluid droplets on a substrate; each of said modules comprising:

a housing comprising a printing fluid reservoir for said high viscosity printing fluid, said reservoir having a first longitudinal direction and including a plurality of openings oriented in a second direction perpendicular to said first direction; and a plurality of directional channels each extending in said second direction from one of said openings, each channel having a cylindrical passageway coaxial with its respective opening and extending for a length in said second direction for feeding said high viscosity printing fluid from said reservoir and its respective opening, the cylindrical passageway of each channel including at its end opposite to its respective opening, an end wall formed with an orifice defining a nozzle through which a continuous jet of said high viscosity printing fluid is discharged onto said substrate.

12. Apparatus according to claim 11 also comprising a control system for controlling the viscosity of said high viscosity fluid.

13. Apparatus according to claim 11 also comprising a charging and deflecting unit for charging printing fluid droplets not applied on said substrate.

14. Apparatus according to claim 13 wherein said charging unit comprises a plurality of charging plates, each plate comprising two conductive elements separated by an insulating separator and wherein in operation one conductive element is charged and the other conductive element is grounded.

15. Apparatus according to claim 11 also comprising a sensing unit for sensing malfunctions in said fluid droplets.

16. Apparatus according to claim 15 wherein said sensing unit is a movable sensing unit.

17. Apparatus according to claim 16 also comprising a cleaning unit operative to clean said channels and said charging plates.

18. Apparatus according to claim 11 wherein said fluid is a printing fluid or a coating fluid having a viscosity of 10–100 centipoise.

* * * * *